US008206149B2

(12) United States Patent
Ohlsen et al.

(10) Patent No.: US 8,206,149 B2
(45) Date of Patent: Jun. 26, 2012

(54) DEMOUNTABLE BURNER

(75) Inventors: Ib Ohlsen, Gentofte (DK); Lars Skaarup Jensen, Vallensbaek (DK); Erik Jepsen, Vejby (DK); Ejvind Rödtnes Jörgensen, Köpenhamn (DK)

(73) Assignee: Flsmidth A/S, Valby (DK)

( * ) Notice: Subject to any disclaimer, the term of this patent is extended or adjusted under 35 U.S.C. 154(b) by 430 days.

(21) Appl. No.: 12/447,682

(22) PCT Filed: Oct. 22, 2007

(86) PCT No.: PCT/IB2007/054282

§ 371 (c)(1),
(2), (4) Date: May 7, 2009

(87) PCT Pub. No.: WO2008/065555

PCT Pub. Date: Jun. 5, 2008

(65) Prior Publication Data

US 2010/0068667 A1 Mar. 18, 2010

(30) Foreign Application Priority Data

Nov. 29, 2006 (DK) ..... 2006 01565

(51) Int. Cl.
*F23Q 9/00* (2006.01)

(52) U.S. Cl. ..... 431/284; 431/187; 285/123.1; 285/123.15

(58) Field of Classification Search ..... 431/187, 431/284, 278; 285/123.1, 123.15
See application file for complete search history.

(56) References Cited

U.S. PATENT DOCUMENTS 1,475,150 A * 11/1923 Sweney ..... 285/261
(Continued)

FOREIGN PATENT DOCUMENTS

EP 967434 A1 12/1999
(Continued)

OTHER PUBLICATIONS

International Search Report and Written Opinion issued in PCT/IB2007/054282.

*Primary Examiner* — Kenneth Rinehart
*Assistant Examiner* — Jorge Pereiro
(74) *Attorney, Agent, or Firm* — Jeffrey S. Melcher; Manelli Selter PLLC

(57) ABSTRACT

A description is given of a burner for introducing solid, liquid or gaseous fuel into the burning zone of a kiln, such as rotary kiln for manufacturing cement clinker or "similar materials, said burner comprising a burner pipe (1) which encircles a number of ducts for conveying fuel and combustion air through the burner. The burner is characterized in that the burner pipe (1) is made up of modules (1*a*, 1*b*) which are fixed to another by fixing means (9) which will allow non-destructive assembly and disassembly of the modules. Hereby is obtained a burner in which it will be possible in a simple and non-destructive manner to disassembly the burner pipe (1) in modules (1*a*, 1*b*) in direction from the free end of the burner (7) or the burner tip. As a result, the outermost module of the burner pipe (1) which constitutes the burner tip can easily be disassembled for repair or replacement and/or for repair or replacement of components incorporated in the burner tip so that maintenance and upgrading of the burner to the latest technology can be carried out in the simple and non-destructive manner.

10 Claims, 2 Drawing Sheets

U.S. PATENT DOCUMENTS

Figure 1:
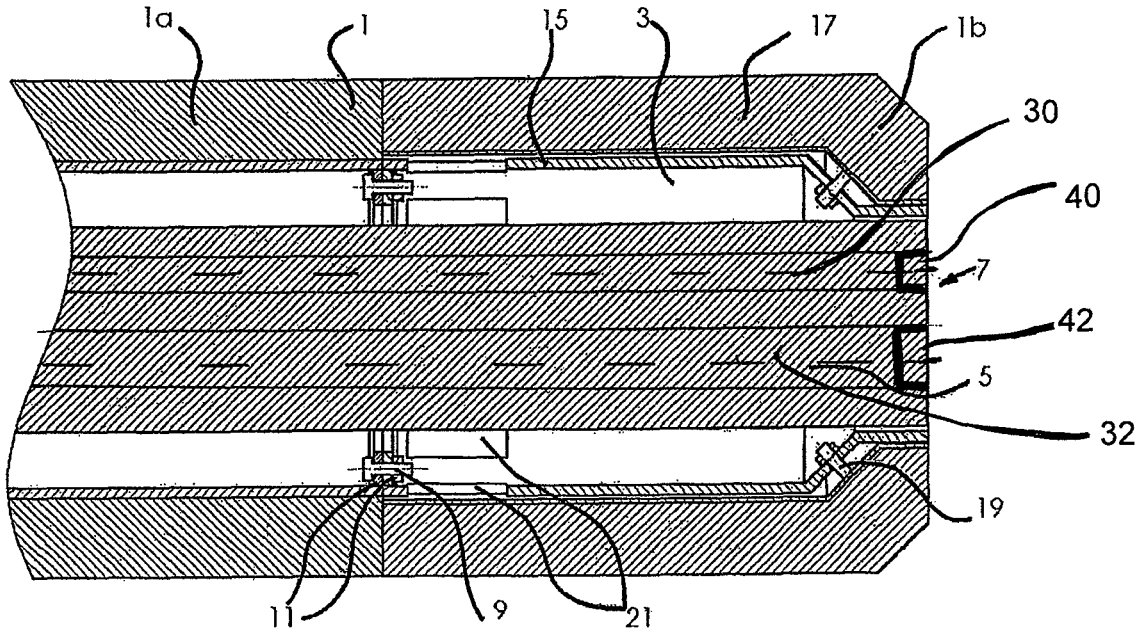

| | | | | | |
|---|---|---|---|---|---|
| 2,904,324 | A | * | 9/1959 | Aitchison | 432/76 |
| 3,342,242 | A | * | 9/1967 | Verloop | 431/284 |
| 3,362,790 | A | * | 1/1968 | Wood et al. | 422/151 |
| 3,378,283 | A | * | 4/1968 | Boocock et al. | 285/187 |
| 3,399,950 | A | | 9/1968 | Quirk | |
| 3,685,740 | A | * | 8/1972 | Shepherd | 239/400 |
| 3,802,744 | A | * | 4/1974 | Grawey et al. | 301/64.305 |
| 3,856,457 | A | * | 12/1974 | Miller | 431/353 |
| 3,905,751 | A | | 9/1975 | Hemsath | |
| 3,918,889 | A | | 11/1975 | Green | |
| 4,155,702 | A | * | 5/1979 | Miller et al. | 431/353 |
| 4,341,512 | A | | 7/1982 | Wojcieson | |
| 4,552,386 | A | * | 11/1985 | Burchette | 285/187 |
| 4,624,631 | A | * | 11/1986 | Kobayashi et al. | 431/9 |
| 4,628,832 | A | * | 12/1986 | Vosper | 110/261 |
| 5,154,597 | A | * | 10/1992 | Fullemann et al. | 431/116 |
| 5,215,259 | A | * | 6/1993 | Wark | 239/587.6 |
| 5,843,368 | A | | 12/1998 | Gitman | |
| 5,882,184 | A | * | 3/1999 | Feldermann | 431/9 |
| 5,944,507 | A | * | 8/1999 | Feldermann | 431/189 |
| 2011/0108151 | A1 | * | 5/2011 | Lee | 138/175 |

FOREIGN PATENT DOCUMENTS

| | | | |
|---|---|---|---|
| EP | 965019 | B1 | 11/2001 |

* cited by examiner

DEMOUNTABLE BURNER

CROSS-REFERENCE TO RELATED APPLICATIONS

This application is a national stage entry under 35 U.S.C. 371 of International Application No. PCT/IB2007/054282, filed 22 Oct. 2007, designating the United States. This application claims foreign priority under 35 U.S.C. 119 and 365 to Danish Patent Application No. PA200601565, filed 29 Nov. 2006.

The present invention relates to a burner for introducing solid, liquid or gaseous fuel into the burning zone of a kiln, such as a rotary kiln for manufacturing cement clinker or similar materials, said burner comprising a burner pipe which encircles a number of ducts for conveying fuel and combustion air through the burner to nozzle openings provided at the free end of the burner.

Burners of the aforementioned kind are known for example from EP 965 019 and EP 967 434. It is a common characteristic of these known burners that the burner pipe is a monocoque design, consisting of a metal pipe enclosed by a casing comprising a refractory lining material which is typically cast integral with the metal pipe and being retained by anchors fixed to the metal pipe. During the operation of the burner, a breakdown of the outer casing may occur, particularly that part of the casing which is closest to the free end or the tip of the burner. Also, the inner parts, particularly around the tip of the burner, are very vulnerable in terms of exposure, requiring continuous repair and/or replacement. Furthermore, new research may provide improved solutions for the design of the burner in response to the desire for uncomplicated replacement of the components incorporated in the tip of the burner. The disadvantage of these known burners is that repair and/or replacement of the burner tip is done by chipping off lining material and by cutting away the outer part of the burner, with subsequent reconstruction of the burner by welding and relining. In addition to having a destructive impact, this method is also very slow as well as expensive.

It is the object of the present invention to provide a burner by means of which it will be possible to repair and/or replace the burner tip in a simple and non-destructive manner.

This is obtained by means of a burner of the kind mentioned in the introduction and being characterized in that the burner pipe is made up of modules which are fixed to one another by fixing means which will allow non-destructive assembly and disassembly of the modules.

Hereby is obtained a burner in which it will be possible in a simple and non-destructive manner to disassemble the burner pipe in modules in direction from the free end of the burner or the burner tip. As a result, the outermost module of the burner pipe which constitutes the burner tip can easily be disassembled for repair or replacement and/or for repair or replacement of components incorporated in the burner tip so that maintenance and upgrading of the burner to the latest technology can be carried out in a simple and non-destructive manner.

During operation in, for example, a rotary kiln for manufacturing cement, the burner is subjected to substantial thermal impacts and also substantial amounts of dust will typically be deposited on the surface of the burner. It is therefore preferred that the fixing means are provided on the inner side of the burner pipe in order to ensure freedom from dust and minimum exposure to the high temperatures occurring on the outer side of the burner.

In principle, the fixing means may be made up of any suitable means which can be assembled and disassembled repeatedly. As non-limiting examples of applicable fixing means mention can be made of a thread provided in the metal pipe and/or the lining material of the burner pipe modules, bayonet couplings provided at the end faces of the modules, spring clamps provided for interaction with matching recesses or similar, bolts for screwing into thread or for interaction with nuts.

Burners of the aforementioned kind typically comprise a central part which contains a number of ducts for conveying solid, liquid or gaseous fuel to separate nozzle openings, and being capable of axial displacement back and forth in the burner pipe. In cases where the burner comprises such an axially displaceable central part, access to the inner part of the burner pipe will be provided via a relatively large central opening in the free end of the burner pipe when the central part is axially displaced away from the free end of the burner. If so, it is preferred that the modules of the burner pipe at each of their ends foreseen for connection to another module comprises an inwardly protruding flange which is intended for fixation of the fixing means. It is further preferred that each flange is provided with a number of through-going holes and that the fixing means in this case are made up of bolts and interactively functioning nuts.

In some cases the outermost module of the burner pipe, or in other words the burner tip module, may have a length which is such that the fixing means, substantially in the form of bolts and nuts which retain the outermost module against the remaining part of the burner pipe cannot be reached via the opening in the free end of the burner pipe. If so, it is preferred that at least the outermost module of the burner pipe comprises an annular structure and a casing which is dismountably mounted on the annular structure. The casing may advantageously be fixed to the annular structure by means of fixing means, substantially bolts and possibly nuts which are provided easily accessible in immediate proximity of the opening in the free end of the module. Hence the casing on the outermost module of the burner pipe can be easily disassembled so that the annular structure of the module becomes externally accessible, and in this case it is therefore preferred that the annular structure of at least the outermost module comprises openings in immediate proximity of the inwardly protruding flange which is foreseen for connecting the module with another module, thereby providing access to the fixing means retaining the outermost module to the remaining part of the burner pipe.

The annular structure may be designed in any suitable manner. In one embodiment of the invention the annular structure may be configured as a pipe, substantially of a metal, which is further formed with a number of openings or holes. In a second embodiment, the annular structure may comprise a number of longitudinal, substantially parallel ribs, being retained at their ends in relation to one another by means of annular end pieces which may consist of flanges or pipes, substantially of a metal. For example, the ribs may be made up of plates or pipes.

The casing which is dismountably mounted on the annular structure may in its simplest embodiment be made up a pipe, substantially of a heat-resistant metal. In cases where the burner is subjected to very high temperatures, as for example in a rotary kiln for manufacturing cement clinker, the pipe may further be provided with a refractory lining material which is typically cast integral with the outer side of the metal pipe and fixed hereto by means of anchors. The casing may further consist of a fire-resistant fibre material externally surrounded by a metal pipe, or the casing may be consist of a pipe formed of refractory lining material.

Figure 2A:
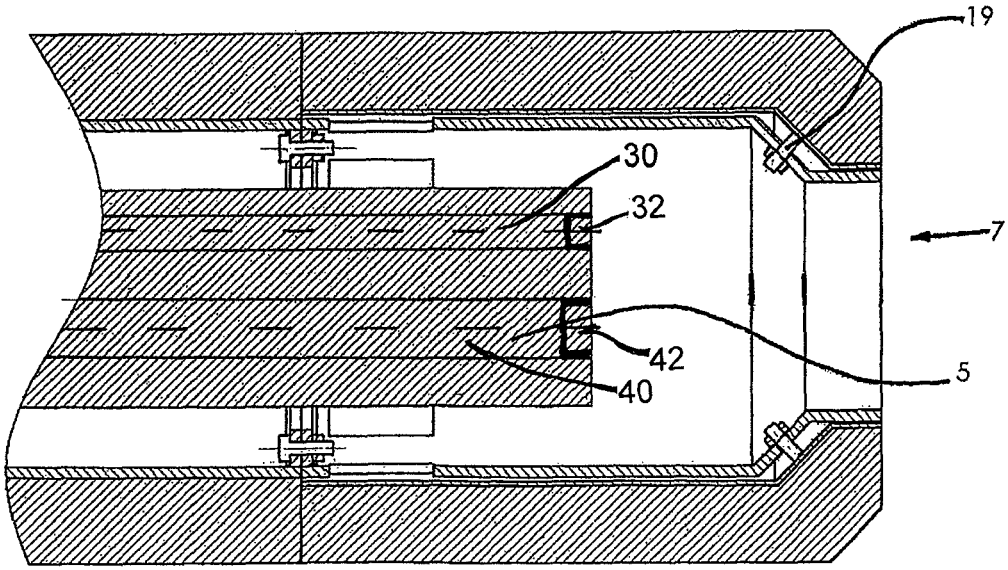
Figure 2B:
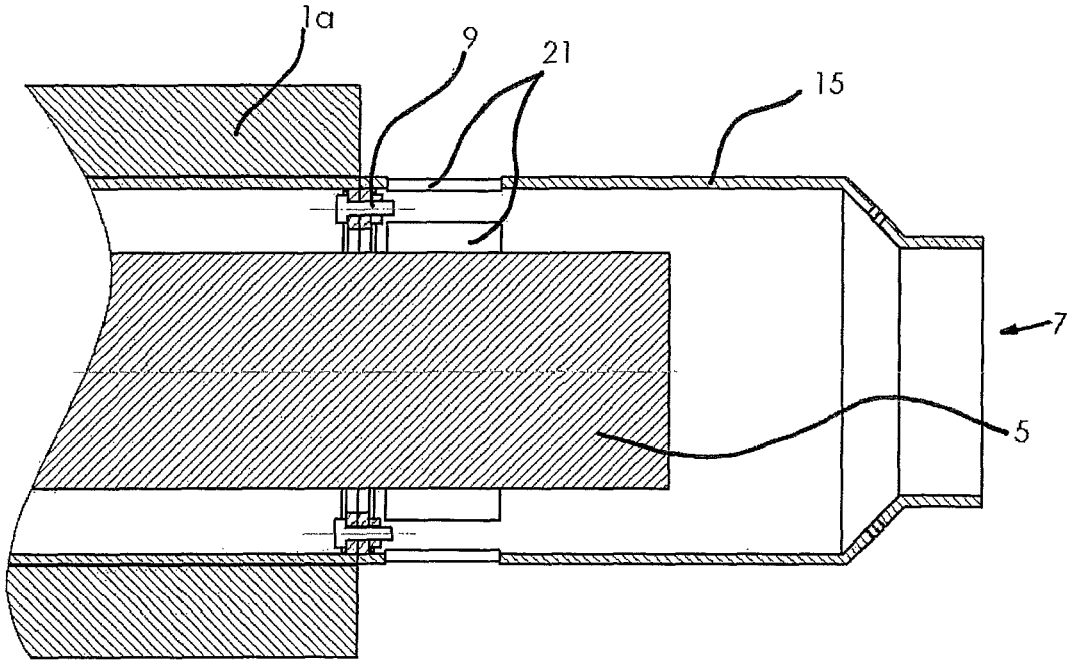
Figure 2C:
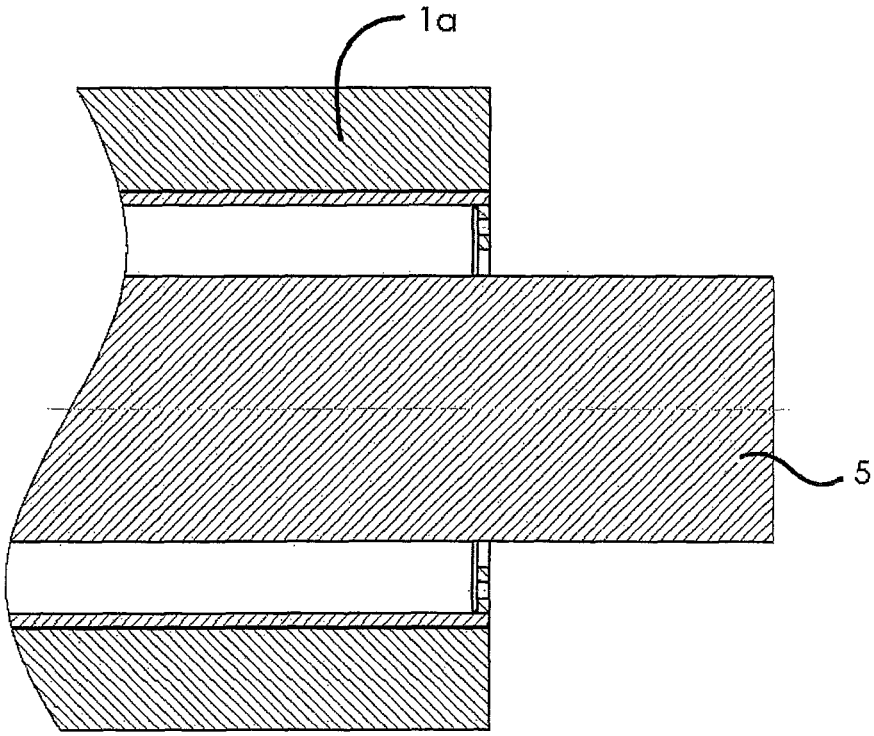

The invention will now be explained in further details with reference to the drawing, being diagrammatical, and where FIG. 1 shows a sectional view of a preferred embodiment of a burner according to the invention, and FIG. 2*a-c* shows how the tip of the burner pipe shown in FIG. 1 can be disassembled in three stages.

In FIG. 1 there is shown a simplified section of a burner according to the invention which comprises a burner pipe 1 which encloses an annular duct 3 and a central part 5. Neither the duct 3 nor the central part 5 is shown in details on the drawing. The duct 3 may thus be divided into several concentric, annular ducts which are typically intended for conveying combustion air while the central part 5 may typically contain a number of separate ducts for conveying solid, liquid or gaseous fuel for separate nozzle openings 40 and 42, corresponding to ducts 30 and 32, respectively, provided at the free end 7 of the burner. In the embodiment shown the central part 5 may further be axially displaced back and forth in the burner pipe 1 as indicated by the double arrow.

According to the invention the burner pipe 1 is made up of modules 1*a* and 1*b* which are fixed to one another by means of suitable fixing means 9 which will allow the modules to be assembled and disassembled in a non-destructive manner in direction towards and away from, respectively, the free end of the burner 7 or the burner tip. Maintenance and upgrading of the burner to the latest technology can therefore be done in a simple and non-destructive manner through simple disassembly of the outermost module 1*b* of the burner pipe 1.

In the embodiment shown, the fixing means 9 consist of bolts and nuts which are fixed in through-going holes in inwardly protruding flanges 11 which are provided at the adjoining ends of the modules 1*a* and 1*b*. This means that the fixing means 9 are fitted to the inner side of the burner pipe 1 so that they are protected against the dust-laden and hot gases outside the burner.

In the embodiment shown, the burner pipe 1 consists of an inner metal pipe 15 externally fitted with a casing 17 which consists of a metal pipe which is clad with a refractory lining material. The casing 17 on the outermost module 1*b* of the burner pipe 1 is dismountably fitted to the metal pipe 15 and fixed to the metal pipe 15 by means of the fixing means 19, substantially as shown in the form of bolts and nuts provided in immediate proximity of the opening in the free end 7 of the module 1*b*. Furthermore, the metal pipe 15 of the outermost module 1*b* is equipped with openings 21 which are provided in immediate proximity of the inwardly protruding flange 11 on the module 1*b* thereby ensuring access to the fixing means 9 which retain the outermost module 1*b* against the remaining part of the burner pipe 1. This design is particularly advantageous in connection with burner pipes where the outermost module 1*b* has a length which is such that the fixing means 9 which retain the outermost module 1*b* against the remaining part of the burner pipe 1 cannot be reached via the opening in the free end 7 of the burner pipe. This design is particularly advantageous in connection with burner pipes where the outermost module 1*b* has a length which is such that the fixing means 9 retaining the outermost module 1*b* against the remaining part of the burner pipe 1 cannot be reached via the opening in the free end 7 of the burner pipe.

FIG. 2*a-c* indicates the procedure for disassembling the outermost module of the burner pipe 1. In FIG. 2*a* the central part 5 is pulled axially away from the free end 7 of the burner pipe so that access is provided to the interior of the burner pipe 1 via a relatively large central opening in the free end 7 of the burner pipe. Subsequently, the bolts 19 can be slackened to allow disassembly of the casing 17 on the outermost module 1*b*, thereby making the metal pipe 15 accessible as shown in FIG. 2*b*. Hence access will be provided via the openings 21 to slacken the bolt/nut assemblies 9 which retain the metal pipe 15 of the outermost module 1*b* to the module 1*a* allowing the latter to be disassembled as shown in FIG. 2*c*.

The invention claimed is:

1. A burner for introducing solid, liquid or gaseous fuel into the burning zone of a kiln, said burner comprising:

a burner pipe which encircles a number of ducts for conveying fuel and combustion air through the burner to nozzle openings provided at a free end of the burner, wherein the burner pipe comprises modules which are fixed to one another by fixing means which allow non-destructive assembly and disassembly of the modules, and that the fixing means are fitted to the inner side of the burner pipe; and a central part which contains at least a portion of the number of ducts for conveying solid, liquid or gaseous fuel to separate nozzle openings, and being capable of axial displacement back and forth in the burner pipe, wherein the modules of the burner pipe at each of their ends foreseen for connection to another module comprises an inwardly protruding flange which is constructed for fixation of the fixing means.

2. A burner according to claim 1, wherein the outermost module of the burner pipe comprises an annular structure and a casing which is dismountably mounted on the annular structure.

3. A burner according to claim 2, wherein the casing is fixed to the annular structure by means of fixing means, which are provided easily accessible in immediate proximity of the opening in the free end of the module.

4. A burner according to claim 2, wherein the annular structure of at least the outermost module comprises openings in immediate proximity of the inwardly protruding flange.

5. A burner according to claim 2, wherein the annular structure is configured as a pipe.

6. A burner according to claim 5, wherein the pipe comprises a metal.

7. A burner according to claim 2, wherein the casing comprises a pipe of a heat-resistant metal, which is provided with a refractory lining material.

8. A burner according to claim 1, wherein the kiln is a rotary kiln for manufacturing cement clinker.

9. A burner for introducing solid, liquid or gaseous fuel into the burning zone of a kiln, said burner comprising:

a burner pipe which encircles a number of ducts for conveying fuel and combustion air through the burner to nozzle openings provided at a free end of the burner, wherein the burner pipe comprises modules which are fixed to one another by fixing means which allow non-destructive assembly and disassembly of the modules, and that the fixing means are fitted to the inner side of the burner pipe and a central part which contains at least a portion of the number of ducts for conveying solid, liquid or gaseous fuel to separate nozzle openings, and being capable of axial displacement back and forth in the burner pipe, wherein the modules of the burner pipe at each of their ends foreseen for connection to another module comprises an inwardly protruding flange which is constructed for fixation of the fixing means, wherein each flange is provided with a number of through-going holes and that the fixing means are made up of bolts and interactively functioning nuts.

10. A burner for introducing solid, liquid or gaseous fuel into the burning zone of a kiln, said burner comprising:

a burner pipe which encircles a number of ducts for conveying fuel and combustion air through the burner to nozzle openings provided at a free end of the burner, wherein the burner pipe comprises modules which are fixed to one another by fixing means which allow non-destructive assembly and disassembly of the modules, and that the fixing means are fitted to the inner side of the burner pipe, wherein the outermost module of the burner pipe comprises an annular structure and a casing which is dismountably mounted on the annular structure, and wherein the annular structure comprises a number of longitudinal, substantially parallel ribs, being retained at their ends in relation to one another by means of annular end pieces.

* * * * *